US009079416B2

(12) United States Patent
Ito

(10) Patent No.: US 9,079,416 B2
(45) Date of Patent: Jul. 14, 2015

(54) LIQUID EJECTION APPARATUS

(71) Applicant: Brother Kogyo Kabushiki Kaisha, Nagoya-shi, Aichi-ken (JP)

(72) Inventor: Takashi Ito, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/316,947

(22) Filed: Jun. 27, 2014

(65) Prior Publication Data

US 2015/0085003 A1 Mar. 26, 2015

(30) Foreign Application Priority Data

Sep. 26, 2013 (JP) ..... 2013-200066

(51) Int. Cl.

| | |
|---|---|
| ***B41J 29/38*** | (2006.01) |
| ***B41J 2/195*** | (2006.01) |
| ***B41J 2/17*** | (2006.01) |
| ***B41J 2/175*** | (2006.01) |

(52) U.S. Cl.

CPC ..... *B41J 2/17596* (2013.01)

(58) Field of Classification Search

USPC ..... 347/6–7, 84–86

See application file for complete search history.

(56) References Cited

U.S. PATENT DOCUMENTS 6,126,267 A 10/2000 Ito et al.
2011/0128313 A1* 6/2011 Matoba ..... 347/6

FOREIGN PATENT DOCUMENTS

JP H11-091124 4/1999

* cited by examiner

*Primary Examiner* — Jason Uhlenhake

(74) *Attorney, Agent, or Firm* — Frommer Lawrence & Haug LLP

(57) ABSTRACT

A liquid ejection apparatus includes: a liquid ejection head including (i) an ejection opening portion, (ii) a supply flow passage, and (iii) an actuator, a first tank connected to the liquid ejection head to supply liquid to the supply flow passage; a pump for forcing the liquid in the first tank into the supply flow passage; and a controller. The controller executes: a first control for driving the actuator, or the actuator and the pump such that all the liquid in the first tank flows to the supply flow passage; and a second control for, after a completion of the first control, driving the actuator in a state in which the pump is stopped, to discharge the liquid in the supply flow passage from the ejection opening portion such that an amount of the liquid in the supply flow passage falls within a predetermined range.

6 Claims, 8 Drawing Sheets

LIQUID EJECTION APPARATUS

CROSS REFERENCE TO RELATED APPLICATION

The present application claims priority from Japanese Patent Application No. 2013-200066, which was filed on Sep. 26, 2013, the disclosure of which is herein incorporated by reference in its entirety.

BACKGROUND OF THE INVENTION

1. Field of the Invention

The present invention relates to a liquid ejection apparatus including a liquid ejection head having an ejection surface for ejecting liquid.

2. Description of the Related Art

There is known a printer configured such that a pump discharges ink from a tank in advance of transport of the apparatus.

SUMMARY OF THE INVENTION

When discharging liquid from the inside of a tank, some amount of liquid needs to remain in a head in some cases in order to prevent meniscuses from being broken and air from flowing into the head, for example. Incidentally, a large amount of liquid remaining in the head is not preferable to prevent a leakage of liquid from the head. Accordingly, the liquid needs to be discharged with some degree of accuracy to retain a proper amount of liquid. If the liquid is discharged using a pump, however, the liquid may be discharged with poor accuracy, in other words, a remaining amount of the liquid may greatly deviate from the proper remaining amount of liquid.

This invention has been developed to provide a liquid ejection apparatus capable of satisfying accuracy for a remaining amount of liquid upon discharging liquid from a tank.

The present invention provides a liquid ejection apparatus including: a liquid ejection head including (i) an ejection opening portion from which the liquid ejection head ejects liquid, (ii) a supply flow passage through which the liquid is supplied to the ejection opening portion, and (iii) an actuator configured to apply ejection energy to the liquid in the supply flow passage to cause the liquid to be ejected from the ejection opening portion; a drive configured to drive the actuator to cause the liquid to be ejected from the ejection opening portion; a first tank connected to the liquid ejection head such that when the actuator is driven to eject the liquid from the ejection opening portion, the liquid is supplied to the supply flow passage by an amount corresponding to an amount of the liquid ejected; a pump configured to cause the liquid in the first tank to flow into the supply flow passage; and a controller. The controller is configured to execute: a first control in which the controller controls the drive and the pump to drive the actuator, or the actuator and the pump such that all the liquid in the first tank flows to the supply flow passage; and a second control in which, after a completion of the first control, the controller controls the pump and the drive to drive the actuator in a state in which the pump is stopped, to discharge the liquid in the supply flow passage from the ejection opening portion such that an amount of the liquid in the supply flow passage falls within a predetermined range.

The present invention also provides a method of controlling a liquid ejection apparatus. The liquid ejection apparatus includes: a liquid ejection head including (i) an ejection opening portion from which the liquid ejection head ejects liquid, (ii) a supply flow passage through which the liquid is supplied to the ejection opening portion, and (iii) an actuator configured to apply ejection energy to the liquid in the supply flow passage to cause the liquid to be ejected from the ejection opening portion; a drive configured to drive the actuator to cause the liquid to be ejected from the ejection opening portion; a first tank connected to the liquid ejection head such that when the actuator is driven to eject the liquid from the ejection opening portion, the liquid is supplied to the supply flow passage by an amount corresponding to an amount of the liquid ejected; and a pump configured to cause the liquid in the first tank to flow into the supply flow passage. The method includes: controlling the drive and the pump to drive the actuator, or the actuator and the pump such that all the liquid in the first tank flows to the supply flow passage; and thereafter controlling the pump and the drive to drive the actuator in a state in which the pump is stopped, to discharge the liquid in the supply flow passage from the ejection opening portion such that an amount of the liquid in the supply flow passage falls within a predetermined range.

BRIEF DESCRIPTION OF THE DRAWINGS

The objects, features, advantages, and technical and industrial significance of the present invention will be better understood by reading the following detailed description of the embodiment of the invention, when considered in connection with the accompanying drawings, in which.

DETAILED DESCRIPTION OF THE EMBODIMENT

Hereinafter, there will be described one embodiment of the present invention by reference to the drawings.

Figure 1:
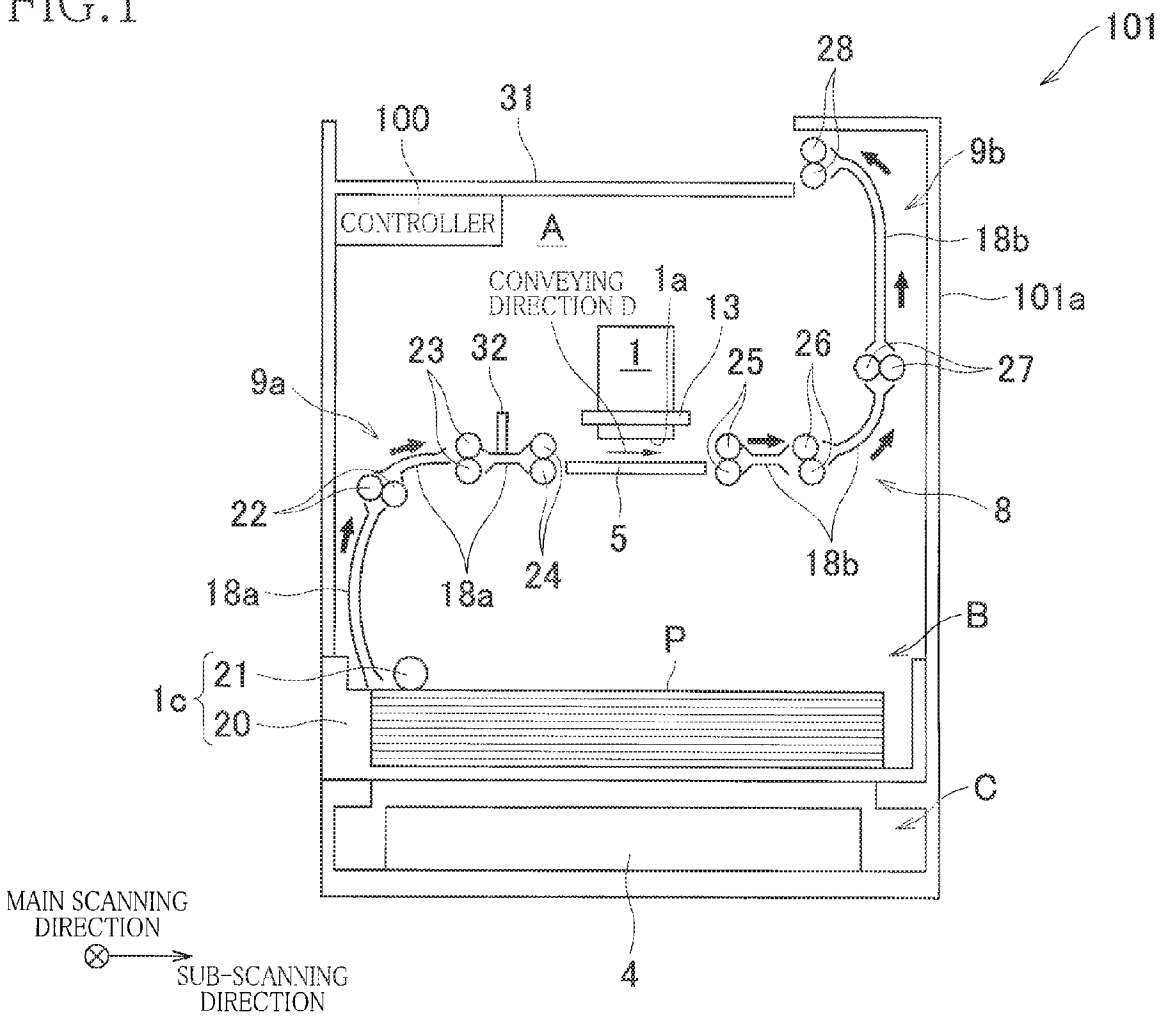
FIG. 1 is a schematic side view illustrating an internal structure of an ink-jet printer according to one embodiment of the present invention.

There will be explained, with reference to FIG. 1, an overall configuration of an ink-jet printer 101 as one example of a liquid ejection apparatus according to one embodiment of the present invention.

The printer 101 includes a housing 101*a* having a rectangular parallelepiped shape. A sheet-output portion 31 is provided on a top plate of the housing 101*a*. An inner space of the housing 101*a* can be divided into spaces A, B, C in order from an upper side thereof. Formed in the spaces A, B is a sheet conveyance path that extends from a sheet-supply unit 1*c* to the sheet-output portion 31. A recording medium in the form of a sheet P is conveyed through this sheet conveyance path along bold arrows illustrated in FIG. 1. In the space A, image recording on the sheet P and the conveyance of the sheet P to the sheet-output portion 31 are performed. In the space B, the sheet P is supplied to the conveyance path. Mounted in the space C is a cartridge 4 from which ink is supplied to a head 1 provided in the space A.

Devices and components provided in the space A include: the head 1 configured to eject black ink; a cap member 7 for covering a lower surface 1*a* of the head 1; a conveyor mechanism 8; a sheet sensor 32; and a controller 200. The controller 200 controls operations of the devices and components of the printer 101 to control the printer 101.

The conveyor mechanism 8 includes a platen 5 and two guide units 9*a*, 9*b* for guiding the sheet P. The two guide units 9*a*, 9*b* are arranged on opposite sides of the platen 5, and the guide unit 9*a* is disposed upstream of the guide unit 9*b* in a sheet conveying direction D in which the sheet P is conveyed. The guide unit 9*a* includes three guides 18*a* and three conveyor roller pairs 22-24 and connects between the sheet-supply unit c and the platen 5. The guide unit 9*a* conveys the sheet P to the platen 5 for image recording. The guide unit 9*b* includes three guides 18*b* and four conveyor roller pairs 25-28 and connects between the platen 5 and the sheet-output portion 31. The guide unit 9*b* conveys the sheet P to the sheet-output portion 31 after the image recording.

The head 1 has a multiplicity of ejection openings 108 (see FIG. 4) through which the ink is ejected. The ejection openings 108 are formed in the lower surface 1*a* as an ejection surface 1*a*. The head 1 is supported by the housing 101*a* via a head holder 13.

Figure 2:
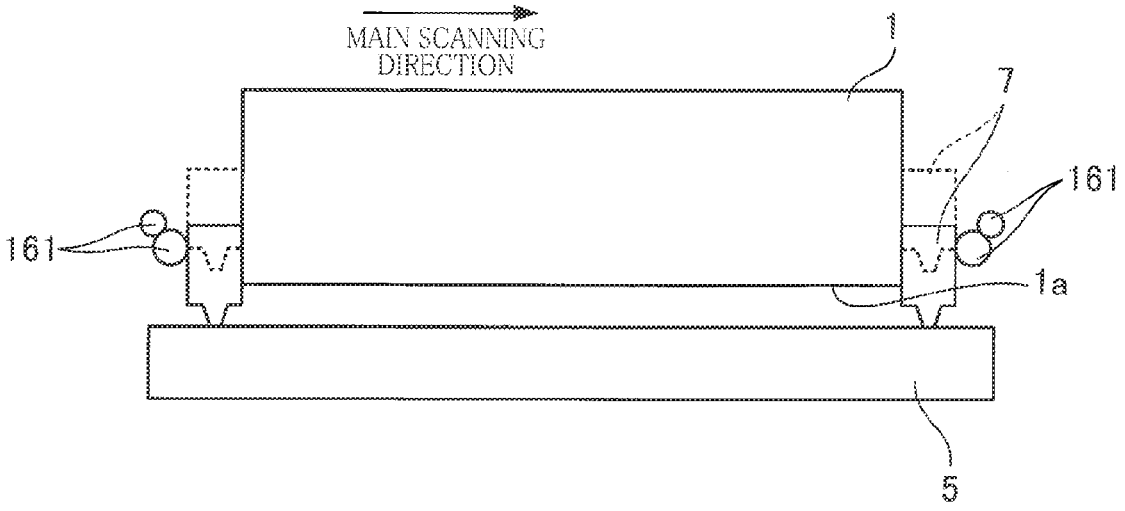
FIG. 2 is a front elevational view schematically illustrating structures of a cap member and a cap moving mechanism.

As illustrated in FIG. 2, the cap member 7 is provided on side surfaces of the head 1. The cap member 7 is an elastic member enclosing outer edges of the ejection surface 1*a* in plan view. A lower end portion of the cap member 7 tapers downward. The cap member 7 is movable upward and downward by a cap moving mechanism 161. The cap moving mechanism 161 includes a plurality of gears and a drive motor for driving these gears. The cap member 7 is driven by these gears and moved in the vertical direction. This vertical movement moves the cap member 7 selectively to one of: an upper position (indicated by broken lines) at which the lower end of the cap member 7 is located above the ejection surface 1*a*; and a lower position (indicated by solid lines) at which the lower end is located below the ejection surface 1*a*. At the lower position, as illustrated in FIG. 2, the lower end is held in contact with an upper surface of the platen 5, so that a space under the ejection openings 108 is enclosed by the ejection surface 1*a*, the platen 5, and the cap member 7. This state suppresses communication between air in this space and ambient air, preventing drying of ink near the ejection openings 108. The controller 200 controls the cap moving mechanism 161 such that the cap member 7 is disposed at the upper position during image recording and at the lower position when the printer 101 is turned off, for example.

The sheet sensor 32 is disposed upstream of a conveyor roller pair 24 and senses a leading edge of the sheet P conveyed. Upon sensing of the leading edge, the sheet sensor 32 outputs a sense signal which is used for synchronization of driving of the head 1 and driving of the conveyor mechanism 8 in image forming on the sheet P. As a result, an image is formed on the sheet P at desired resolution and speed.

The sheet-supply unit 1*c* is disposed in the space B. The sheet-supply unit 1*c* includes a sheet-supply tray 20 and a sheet-supply roller 21. The sheet-supply tray 20 is mountable and removable on and from the housing 101*a*. The sheet-supply tray 20 can store a plurality of sheets P. The sheet-supply roller 21 supplies an upper one of the sheets P stored in the sheet-supply tray 20.

Here, a sub-scanning direction is a direction parallel to the sheet conveying direction D (indicated by arrow D in FIG. 1) in which the sheet P is conveyed by the conveyor roller pairs 23-25, and a main scanning direction is a direction parallel to a horizontal plane and perpendicular to the sub-scanning direction.

Figure 3:
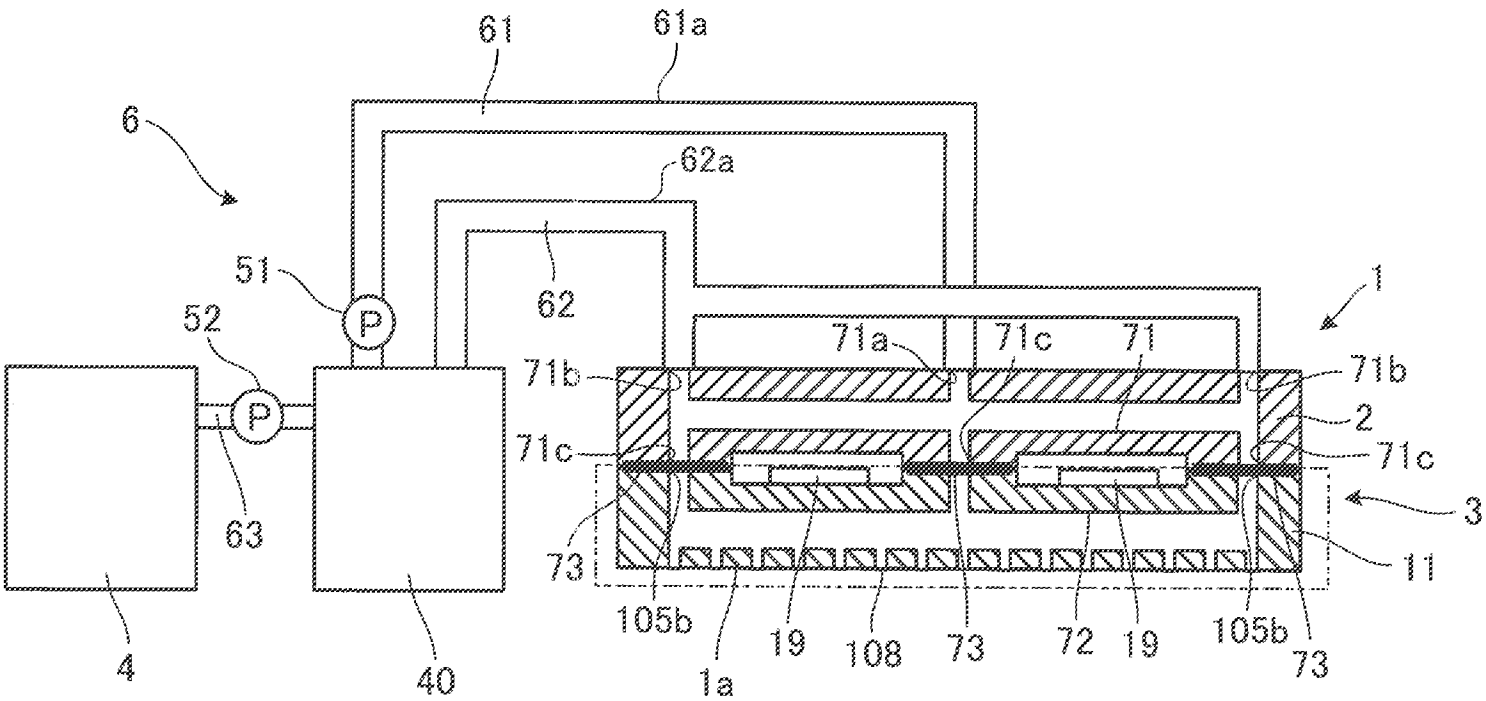
FIG. 3 is a conceptual view illustrating an ink-supply mechanism and a head.

In the space C, the cartridge 4 storing the black ink is removably disposed on the housing 101*a*. As illustrated in FIG. 3, the cartridge 4 is connected to the head 1 via an ink-supply mechanism 6. The ink-supply mechanism 6 includes: a sub-tank 40 for temporarily storing the ink supplied from the cartridge 4; ink passages 61-63 defined by ink tubes and other similar components; and pumps 51, 52. The pumps 51, 52 are driven by a pump drive circuit 152 under control of the controller 200 (see FIG. 7).

Figure 4:
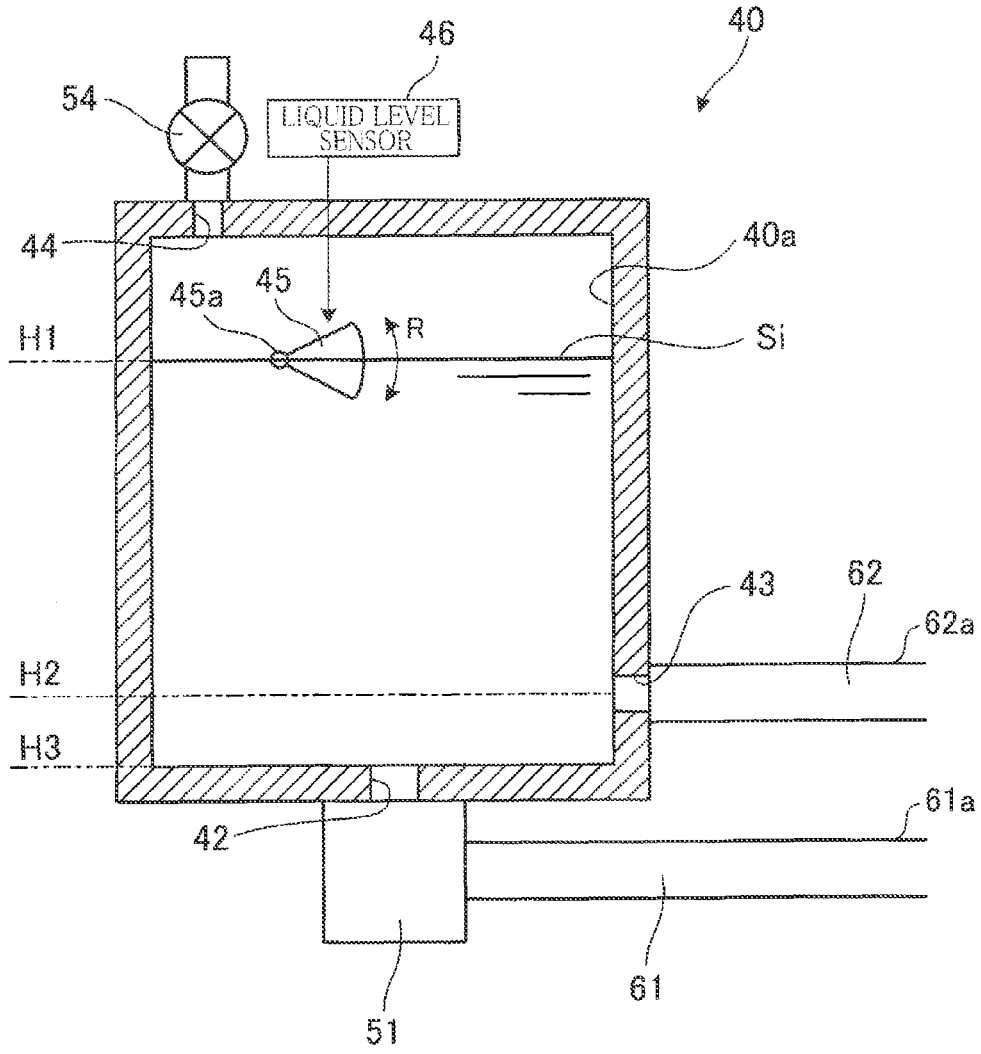
FIG. 4 is a view illustrating an elevational view in vertical cross section illustrating a sub-tank, with components therearound illustrated.

As illustrated in FIG. 4, the sub-tank 40 has an ink chamber 40*a* therein for storing ink. Outer walls of the sub-tank 40 have holes 42-44 through which the ink chamber 40*a* and the outside can communicate with each other. The hole 42 is formed in a bottom surface of the ink chamber 40*a* and communicates with the ink passage 61 (as one example of a first liquid passage) via the pump 51. The ink passage 61 is formed in a first tube 61*a* (as one example of a first passage forming member), and a connecting portion of the sub-tank 40 which is connected to the first tube 61*a* is the hole 42. The hole 42 is one example of a first connecting portion. The hole 43 communicates with the ink passage 62 (as one example of a second liquid passage). The ink passage 62 is formed in a second tube 62*a* (as one example of a second passage forming member), and a connecting portion of the sub-tank 40 which is connected to the second tube 62*a* is the hole 43. The hole 43 is one example of a second connecting portion. The hole 43 is formed above the bottom surface of the ink chamber 40*a*. The hole 44 establishes communication between the atmosphere and the ink chamber 40*a* via a switching valve 54. The switching valve 54 is controlled by the controller 200 to switch between a state in which the ink chamber 40*a* communicates with the atmosphere via the hole 44 and a state in which this communication is not established.

A float 45 is provided in the ink chamber 40*a*. The float 45 has a mass smaller than that of the ink per unit volume, so that the float 45 floats near a liquid surface Si of the ink in the ink chamber 40*a*. The float 45 includes a rotation shaft 45*a*. The rotation shaft 45*a* is supported by a housing of the sub-tank 40 such that the float 45 is rotatable in a direction indicated by arrow R in FIG. 4. When the liquid surface Si rises or lowers in accordance with the amount of ink in the ink chamber 40*a*, the float 45 rotates in the R direction in conjunction with the change of the level of the liquid surface Si. The sub-tank 40 is provided with a liquid level sensor 46 capable of sensing the position of the float 45 to sense the level of the liquid surface Si.

As illustrated in FIG. 3, the cartridge 4 is connected to the sub-tank 40 by the ink passage 63. The pump 52 applies a pressure to the inside of the ink passage 63 to cause the ink to flow from the cartridge 4 into the sub-tank 40.

The sub-tank 40 and the head 1 are connected to each other by the first tube 61*a* and the second tube 62*a* respectively defining the ink passages 61, 62. The ink passages 61, 62 are respectively formed by ink tubes and the first tube 61*a* and the second tube 62*a* each of which is a flow-passage defining member formed of resin having a flow passage therein, for example. The flow passage formed in the ink tube and the flow passage formed in the flow-passage defining member are connected to each other, thereby forming the ink passage 61 and the ink passage 62.

As illustrated in FIGS. 3 and 4, the first tube 61*a* defining the ink passage 61 extends from the sub-tank 40 to the head 1 via the pump 51 and is connected to a communication opening 71*a* formed in the head 1. The pump 51 applies to a pressure to the inside of the ink passage 61 to cause ink to flow from the sub-tank 40 to the head 1. The pump 51 can switch between a shut-off state in which the ink passage 61 is shut off to inhibit the flow of the ink therethrough and an open state in which the ink can flow through the ink passage 61.

The second tube 62*a* defining the ink passage 62 extends to the head 1 not via the pump. The second tube 62*a* defining the ink passage 62 is branched off at its middle portion, and a plurality of branched flow passages are respectively connected to communication openings 71*b* formed in the head 1. In a case where the pump 51 establishes the shut-off state of the ink passage 61, and the switching valve 54 establishes communication between the ink chamber 40*a* and the atmosphere via the hole 44, the ink in the ink chamber 40*a* automatically flows into the head 1 through the ink passage 62 with consumption of the ink from the head 1.

There will be next explained the construction of the head 1 in detail with reference to FIGS. 3, 5, and 6A-6C. As illustrated in FIG. 3, the head 1 includes: a reservoir unit 2 having an ink passage 71 formed therein; and a head main body 3 having an ink passage 72 formed therein. It is noted that the entire flow passages in the head 1 which are constituted by the ink passages 71, 72 correspond to a supply flow passage. The reservoir unit 2 is constituted by a plurality of metal plates stacked on one another. These metal plates have through holes each partly constituting the ink passage 71, and these through holes are aligned so as to communicate with each other in the stacked body and constitute the ink passage 71.

The ink passage 71 communicates with the ink passage 61 via the communication opening 71*a* which is an opening formed in an upper surface of the reservoir unit 2 and likewise communicates with the ink passage 62 via the communication openings 71*b*. The ink passage 71 also communicates with the ink passage 72 formed in the head main body 3, via communication openings 71*c* each of which is an opening formed in a lower surface of the reservoir unit 2.

Figure 5:
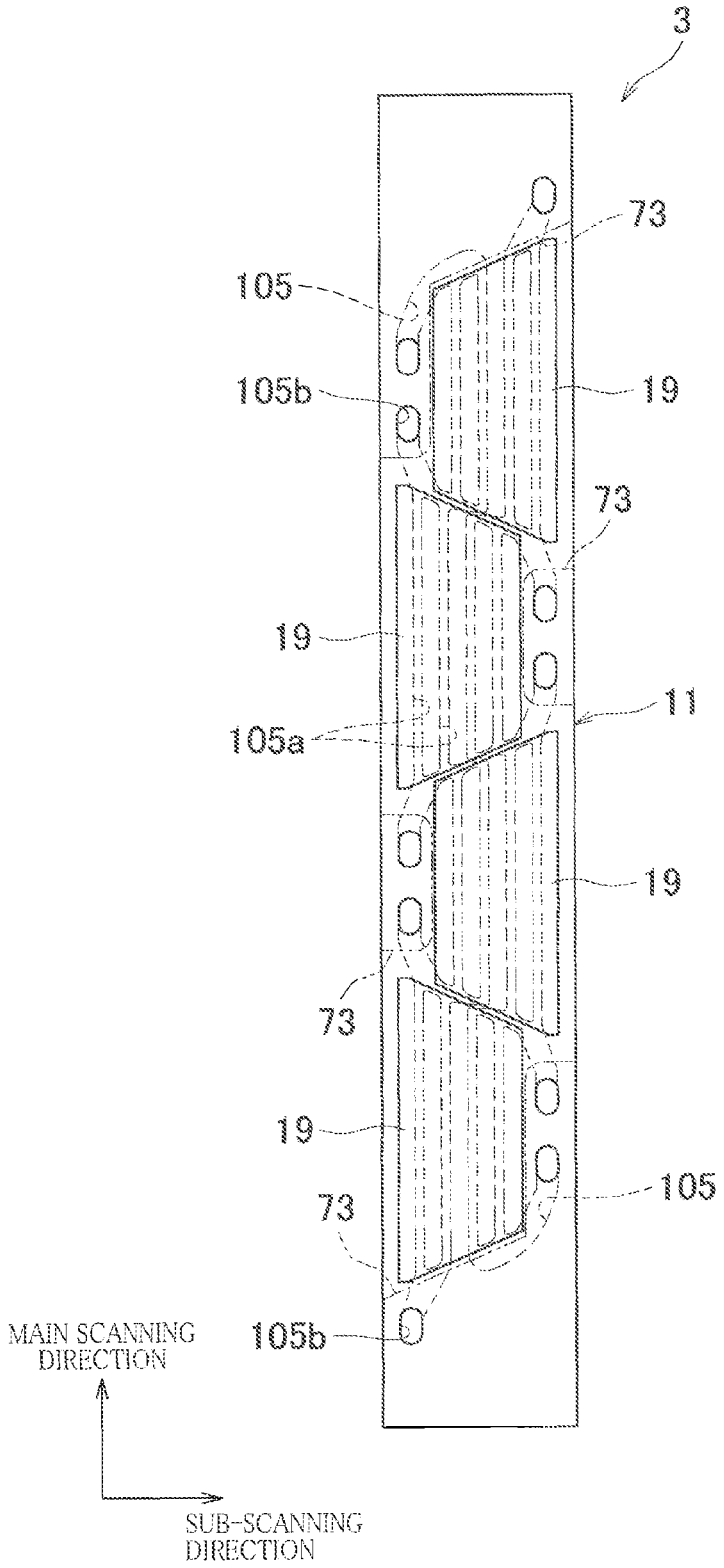
FIG. 5 is a plan view illustrating a head main body.

The head main body 3 includes: a passage unit 11 having the ink passage 72 formed therein; and actuator units 19 for applying pressures to the ink in the ink passage 72. The passage unit 11 is a flow-passage defining member constituted by nine rectangular metal plates 122, 123, 124, 125, 126, 127, 128, 129, 130 (see FIG. 6B) having generally the same shape and stacked on and bonded to one another. As illustrated in FIGS. 3 and 5, openings 105*b* are formed in the upper surface of the passage unit 11. The openings 105*b* communicate with the communication openings 71*c* of the ink passage 71 formed in the reservoir unit 2, via filters 73. The filters 73 remove foreign matters and the like from the ink when the ink in the ink passage 71 flows from the communication openings 71*c* into the ink passage 72 via the openings 105*b*.

Figure 6A:
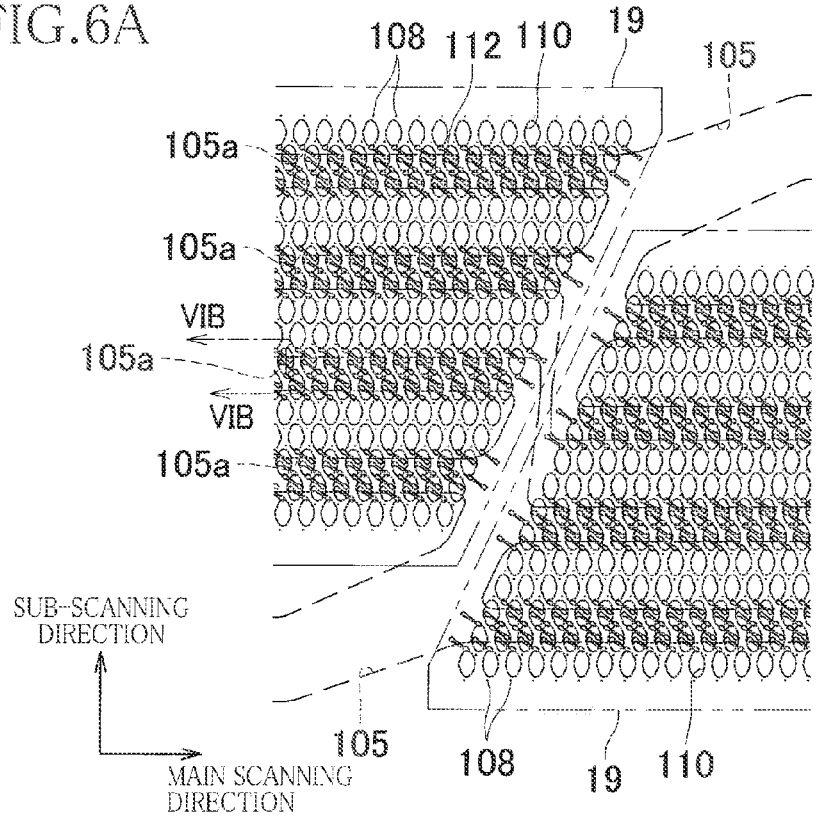
FIG. 6A is an enlarged view illustrating an area enclosed in the one-dot chain line in FIG. 5.
Figure 6B:
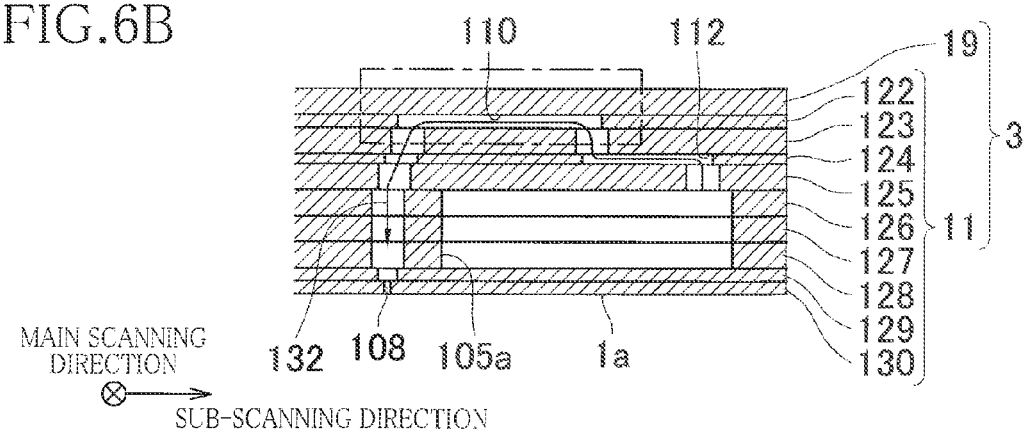
FIG. 6B is cross-sectional view taken along line VIB-VIB in FIG. 5A.

As illustrated in FIGS. 5 and 6A-6C, the ink passage 72 includes: manifold passages 105 each having a corresponding one of the openings 105*b* as one end; sub-manifold passages 105*a* each branched off from a corresponding one of the manifold passages 105; and individual ink passages 132 each extending from an outlet of a corresponding one of the sub-manifold passages 105*a* to a corresponding one of the ejection openings 108 via a corresponding one of pressure chambers 110. In FIG. 6A, the pressure chambers 110 and apertures 112 are illustrated by solid lines for easier understanding though these elements are located under the actuator units 19 and thus should be illustrated by broken lines.

As illustrated in FIG. 5, the actuator units 19 each having a trapezoid shape in plan view are arranged on the upper surface of the passage unit 11 in two rows in a staggered configuration. As illustrated in FIG. 6A, the pressure chambers 110 each having a generally rhombic shape are open in the upper surface of the passage unit 11. These openings are formed in trapezoidal areas of the passage unit 11 which are respectively opposed to the actuator units 19. The ejection openings 108 are open in a lower surface of the passage unit 11 (i.e., the ejection surface 1*a*). The number of the ejection openings 108 is equal to that of the pressure chambers 110.

Figure 6C:
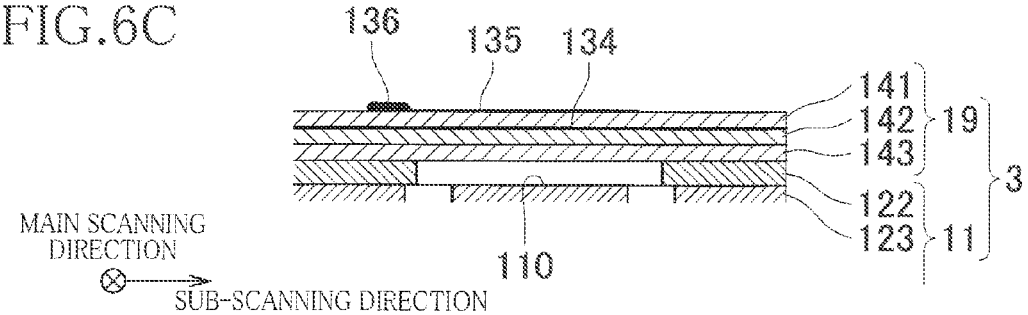
FIG. 6C is an enlarged view illustrating an area enclosed by the one-dot chain line in FIG. 6B.

As illustrated in FIG. 6C, each of the actuator units 19 is constituted by piezoelectric layers 141-143 each formed of a ceramic material of lead zirconate titanate (PZT) having ferroelectricity. A multiplicity of individual electrodes 135 are disposed on an upper surface of the uppermost piezoelectric layer 141 that is polarized in its thickness direction. Individual lands 136 are formed on distal end portions of the respective individual electrodes 135. A common electrode 134 is disposed generally entirely on an upper surface of the piezoelectric layer 142. The common electrode 134 is always kept at ground potential. When a voltage signal is supplied to the individual electrode 135 through the individual land 136, and thereby an electric field is caused between the electrodes 134, 135 in the polarization direction, a portion of the piezoelectric layer 141 as an active portion between the electrodes 134, 135 is contracted in a planar direction. The piezoelectric layers 142, 143 are not deformed actively, which causes difference in amount of deformation between the piezoelectric layer 141 and the piezoelectric layers 142, 143. As a result, a portion of the piezoelectric layers which is sandwiched between the individual electrode 135 and the pressure chamber 110 projects toward the pressure chamber 110 (noted that this projection is called unimorph deformation).

The head 1 includes an electronic component in the form of a head drive circuit 151 as one example of a drive for driving the actuator units 19. The head drive circuit 151 produces a drive signal for driving the actuator units 19, based on a control signal received from the controller 200. The drive signal is selectively supplied to the individual electrodes 135 through the respective individual lands 136. When the drive signal is supplied to the individual electrode 135, a potential difference appears between the common electrode 134 and the individual electrode 135. This potential difference causes unimorph deformation at a portion of the actuator unit 19 which corresponds to the individual electrode 135, and this unimorph deformation applies a pressure to the ink in the pressure chamber 110 corresponding to the individual electrode 135.

The present embodiment adopts what is called a fill-before-fire method for ink ejection. A drive signal in the fill-before-fire method contains one or more voltage pulses. When this drive signal is supplied to the individual electrode 135, the individual electrode 135 is kept at a positive predetermined electric potential when no ink is ejected. When the ink is to be ejected, the potential of the individual electrode 135 is temporarily changed to a ground potential by the voltage pulse and thereafter changed back to the predetermined electric potential at a predetermined timing. In this case, a negative pressure is applied to the ink in the pressure chamber 110 at the timing when the potential of the individual electrode 135 is changed to the ground potential, and a positive pressure is applied to the ink in the pressure chamber 110 at the timing when the potential of the individual electrode 135 is changed back to the predetermined electric potential. The voltage pulse is adjusted such that the potential of the individual electrode 135 is changed back to the predetermined electric potential at the timing when a vibration caused in the ink in the pressure chamber 110 by the first application of the negative pressure reaches the peak of the positive pressure. The next positive pressure is applied so as to be superimposed on the peak of the positive pressure due to the first application of the negative pressure, so that a pressure is efficiently applied to the ink in the pressure chamber 110. As a result, an ink droplet is efficiently ejected from the ejection opening 108.

As described above, the actuators are provided in each actuator unit 19 for the respective pressure chambers 110. These actuators can apply ejection energy to the ink independently of each other. Accordingly, a unit amount of the ink ejected for one voltage pulse contained in the drive signal becomes uniform with high accuracy as long as the voltage pulses have the same shape. In one example, an error of the ejection amount of the ink is within ±2%. In the following description, it is assumed that the actuator unit 19 is driven once by supply of one voltage pulse to the individual electrode 135. It is also assumed that the ink is ejected once by one driving of the actuator unit 19. Also, driving per recording cycle may be set at one driving of the actuator unit 19. This recording cycle is a length of time required for the conveyor mechanism 8 to convey the sheet P by a predetermined unit distance related to a resolution for recording.

Figure 7:
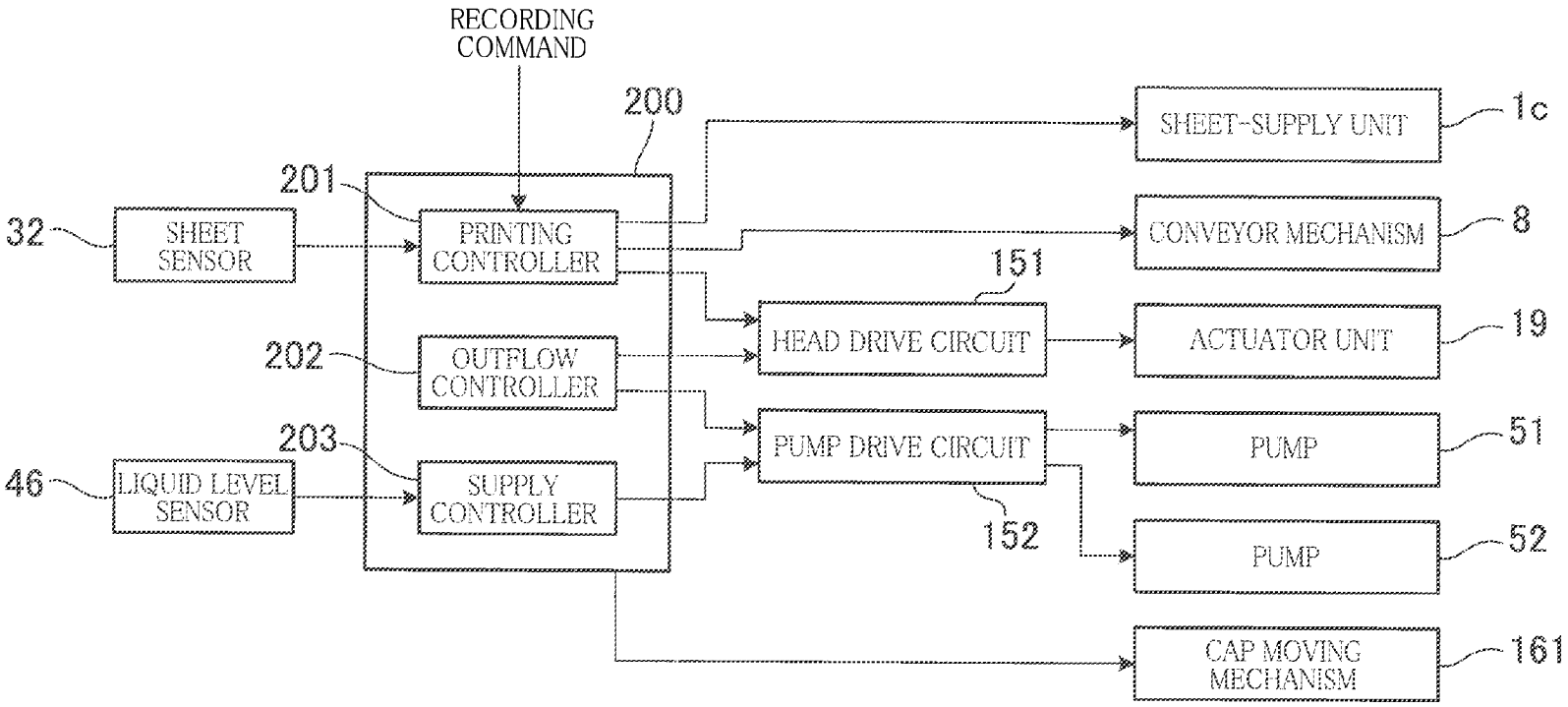
FIG. 7 is a functional block diagram illustrating a controller and components controlled by the controller.
Figure 8:
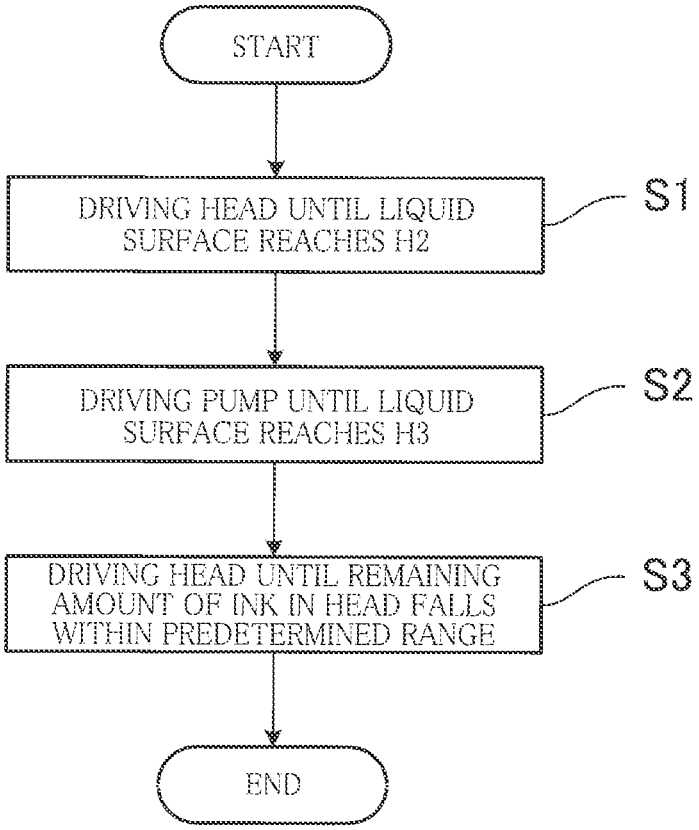
FIG. 8 is a flow chart illustrating an ink removing processing for removing ink from the sub-tank and the head.

There will be next explained control of the controller 200 in detail with reference to FIGS. 7 and 8. As illustrated in FIG. 7, the controller 200 includes a printing controller 201 configured to control an image recording operation based on a recording command (with image data, for example) supplied from an external device such as a PC coupled to the printer 101; an outflow controller 202 configured to cause the ink to flow out of the head 1 at a timing different from the image recording operation; and a supply controller 203 configured to control the supply of the ink from the cartridge 4 to the sub-tank 40.

Upon receiving the recording command, the printing controller 201 drives the sheet-supply unit 1*c* and the conveyor mechanism 8 (i.e., the conveyor roller pairs 22-28). The sheet P is supplied from the sheet-supply tray 20 and conveyed to the platen 5 along bold arrows in FIG. 1 while guided by the upstream guide unit 9*a*. When the sheet P passes through a position just under the head 1 in the sub-scanning direction (i.e., the sheet conveying direction D in FIG. 1), the printing controller 201 controls the head drive circuit 151 to drive the head 1 to form an image on the sheet P based on the recording command. In this control, the ink is ejected from the ejection openings 108 of the head 1, so that a desired image is formed on the sheet P. Timings of this ink ejection are controlled based on the sense signals transmitted from the sheet sensor 32. The sheet P on which the image had been formed is conveyed along bold arrows in FIG. 1 while guided by the downstream guide unit 9*b* and discharged from an upper portion of the housing 101*a* onto the sheet-output portion 31.

The supply controller 203 controls the pump drive circuit 152, based on a result of detection of the liquid surface Si in the sub-tank 40 by the liquid level sensor 46, to cause the pump 52 to force the ink from the cartridge 4 into the sub-tank 40. The supply controller 203 controls the pump drive circuit 152 to keep the level of the liquid surface Si in the sub-tank 40, within a preset range (near the position indicated by H1 in FIG. 4). Thus, even if the ink stored in the sub-tank 40 is consumed by, e.g., the image recording operation, an amount of ink which corresponds to the ink consumption is supplied from the cartridge 4 to the sub-tank 40. Accordingly, an amount of the ink stored in the sub-tank 40 is kept generally constant. The supply controller 203 is one example of a liquid amount keeper.

The outflow controller 202 executes three types of processings for causing the ink to flow out of the head 1. The first processing is a flushing processing. The flushing processing is a processing for controlling the head drive circuit 151 independently of the image recording to cause the head 1 to eject the ink from the ejection openings 108. As a result, ink whose viscosity has increased due to drying is discharged from the head 1, resulting in improved ink ejection characteristics of the ejection openings 108. Even if the ink stored in the sub-tank 40 is consumed in the flushing processing, the control of the supply controller 203 supplies the ink from the cartridge 4 by an amount corresponding to the ink consumption.

The second processing is a purging processing. The purging processing is a processing for controlling the pump drive circuit 152 to force the ink from the sub-tank 40 into the head 1 via the ink passage 61. As a result, the ink in the head 1 is discharged through the ejection openings 108. As in the flushing processing, the ink whose viscosity has increased due to drying is discharged in the purging processing in order to improve the ink ejection characteristics of the ejection openings 108. Even if the ink stored in the sub-tank 40 is consumed in the purging processing, the control of the supply controller 203 supplies the ink from the cartridge 4 by an amount corresponding to the ink consumption.

The third processing is an ink removing processing (as one example of a first control and a second control) for removing the ink from the sub-tank 40 and the head 1. This processing is executed in the cases where the printer 101 is transported and where the printer 101 is stored without use thereof for a relatively long period, for example. The transportation and storage are carried out in the state in which the cap member 7 is located at the lower position (indicated by the solid lines in FIG. 2). Accordingly, even if some amount of ink remains in the head 1, and the ink has leaked from the ejection openings 108 in, e.g., the transportation, the leaked ink is retained in the space enclosed by the ejection surface 1*a*, the cap member 7, and the platen 5. In the case where a large amount of ink remains in the head 1, however, all the leaked ink cannot be retained by the cap member 7, leading to a leakage of the ink from a position between the cap member 7 and the platen 5. The leaked ink may stain the components of the printer 101.

In order to solve this problem, in the ink removing processing, the supply controller 203 stops the control for maintaining the level of the liquid surface Si, that is, the supply controller 203 stops the supply of the ink from the cartridge 4 to the sub-tank 40 by the pump 52, and all the ink is discharged from the sub-tank 40 storing a large amount of ink to be supplied to the head 1. From the head 1, the ink is removed such that some amount of ink remains in the head 1. If all the ink is removed from the head 1, meniscuses may be broken in the ejection openings 108, or air may flow into the head 1, resulting in reduced ink ejection characteristics of the ejection openings 108 when using the printer 101 again. To solve this problem, the ink is removed such that some amount of ink remains in the head 1.

Considering the ink ejection characteristics in the use of the printer 101 again, the ink preferably remains in the head 1 such that the passage unit 11 is filled with ink. Specifically, the ink is preferably removed from the head 1 such that the remaining ink fills the entire space in the ink passage 72 that connects between the ejection openings 108 and the filters 73 disposed at a boundary between the reservoir unit 2 and the passage unit 11. That is, the ink preferably remains so as to fill an area enclosed by the two-dot chain lines in FIG. 3. However, it is usually difficult to adjust the remaining amount of the ink such that the ink fills only the passage unit 11 accurately. Thus, the remaining amount of the ink in the head 1 in most cases deviates from the above-described optimum amount. Some amount of ink may remain also in the ink passage 71 formed in the reservoir unit 2, and the passage unit 11 may not be filled with ink. As described above, however, an excessively large amount of remaining ink causes a leakage of ink from the ejection openings 108, and a small amount of remaining ink causes reduced ink ejection characteristics of the ejection openings 108 when using the printer 101 again. This problem requires an upper limit and a lower limit for the remaining amount of ink in the head 1. In one example, the upper limit is 8 ml, and the lower limit is 1 ml.

In an ink removing processing using the conventional method, the pump 51 is driven to discharge ink from the sub-tank 40 and the head 1 as in the above-described purging processing. In this case, however, since ink is supplied to the head 1 from the outside to discharge ink from the ejection openings 108, it is difficult to accurately adjust an amount of ink to be discharged. In one example, the amount of ink discharged by the driving of the pump 51 may have an error of about ±10%. Since all the ink is discharged from the sub-tank 40 in the ink removing processing, the amount of discharged ink has an error of about ±10% of at least the capacity of the sub-tank 40. As described above, the lower limit and the upper limit are required for the remaining amount of ink in the head 1. In the case where the ink is discharged from the head 1 only by the driving of the pump 51, the remaining amount of the ink may fall out of the permissible range (1-8 ml) by the error of the ink discharge amount by about ±10% in the above-described example.

To solve this problem, the outflow controller 202 (as one example of an outflow controller) as in the flushing processing controls the head drive circuit 151 to drive the actuator units 19 to discharge the ink from the head 1. In a case where the ink is ejected from the ejection openings 108 in this manner, the error of the ejection amount of the ink is within ±2% in the above-described example. Accordingly, the ink discharge amount can be adjusted accurately when compared with the case where the ink is discharged by the driving of the pump 51. This allows the remaining amount of the ink to easily fall within the permissible range.

Furthermore, the outflow controller 202 in the present embodiment executes the ink removing processing by using both of the driving of the actuator units 19 and the driving of the pump 51. This is because, as illustrated in FIG. 4, the hole 43 as a communication portion for connecting between the ink passage 62 and the ink chamber 40*a* is disposed above the bottom surface of the sub-tank 40. During driving of the actuator units 19, the ink flows out of the sub-tank 40 via the ink passage 62 as described above. Thus, even if the ink is discharged only by the driving of the actuator units 19, the ink is discharged only by such an amount that the level of the liquid surface Si moves to the level of the hole 43 in the sub-tank 40.

In view of the above, the outflow controller 202 in the present embodiment executes the ink removing processing by controlling the head drive circuit 151 and the pump drive circuit 152 in the following manner. There will be explained the flow of the ink removing processing with reference to FIG. 8. The outflow controller 202 starts this processing in a state in which the liquid surface Si in the sub-tank 40 is located near H1 in FIG. 4. The liquid surface Si is located near H1 because the level of the liquid surface Si is maintained by the supply controller 203 as described above. The outflow controller 202 then controls the head drive circuit 151 to cause the head 1 to discharge the ink until the level of the liquid surface Si reaches H2 that is the level of the hole 43 (S1).

A target amount of ink to be discharged in this operation (hereinafter referred to as "target ink-discharge amount at S1") is a fixed amount related to the lowering of the liquid surface Si in the sub-tank 40 from H1 to H2. Thus, the outflow controller 202 is predetermined to control the head 1 to eject the ink from the ejection openings 108 a predetermined number of times related to this fixed amount. The reason why the number of ink ejections (i.e., the number of drivings of the actuator units 19) can be determined in advance in this manner is that the ink removing processing is started in the state in which the liquid surface Si is maintained at H1 by the supply controller 203. According to the above-described example, the actual ink discharge amount may deviate from the target ink-discharge amount due to the error of ±2% (hereinafter the deviation may be referred to as "deviation at S1").

The outflow controller 202 at S2 controls the pump drive circuit 152 to cause the head 1 to discharge the ink until the level of the liquid surface Si reaches H13 in FIG. 4, i.e., the bottom surface of the ink chamber 40*a*, that is, until the sub-tank 40 becomes empty of ink. A target amount of ink to be discharged in this operation (hereinafter referred to as "target ink-discharge amount at S2") is a fixed amount related to the lowering of the liquid surface Si from H2 to H3. Accordingly, the pump 51 is driven by an amount related to this fixed amount. According to the above-described example, the actual ink discharge amount may deviate from the target ink-discharge amount due to the error of ±10% (hereinafter the deviation may be referred to as "deviation at S2").

The outflow controller 202 at S3 controls the head drive circuit 151 to cause the head 1 to discharge the ink until the remaining amount of the ink in the head 1 falls within a predetermined range. Since the ink remains in the ink passages 61, 62 in the state established just after S2, all the ink is discharged from these flow passages, and the ink is discharged from the head 1 such that the predetermined amount of ink remains in the head 1. A target amount of ink to be discharged in this operation (hereinafter referred to as "target ink-discharge amount at S3") is the sum of the total capacity of the ink passages 61, 62 and an amount obtained by subtracting the remaining amount of ink from the total capacity of the head 1. Accordingly, the outflow controller 202 is predetermined to control the head 1 to eject the ink from the ejection openings 108 a number of times corresponding to this total amount. According to the above-described example, the actual ink discharge amount may deviate from the target ink-discharge amount due to the error of ±2% (hereinafter the deviation may be referred to as "deviation at S3"). The target ink-discharge amount at S3 and the number of ink ejections are represented as follows:

(Target Ink-discharge Amount at *S*3)=(Total Capacity of Ink Passage 61)+(Total Capacity of Ink Passage 62)+(Total Capacity in Head 1)−(Target Remaining Amount)

(Number of Ejections)=(Target Ink-discharge Amount at *S*3)/(Ink Ejection Amount per Ejection)

The actual ink discharge amount may have the deviations at S1-S3. Thus, a target value of the remaining amount of ink is preferably set at an intermediate value of the permissible range in order to facilitate that the remaining amount falls within the permissible range. The number of ejections is preferably set such that the remaining amount of the ink does not fall outside the permissible range even if the possible largest deviation occurs. According to the above-described example, the target value of the remaining amount is set at 4.5 ml which is an intermediate value of 1-8 ml. The possible largest deviation needs at S1-S3 not to exceed 3.5 ml that is a difference between 4.5 ml as the target value and the upper limit value or the lower limit value. The possible largest deviation at S1-S3 may be determined based on, e.g., measured values. For example, assuming that a deviation of 2% is the largest at S and S3, and a deviation of 10% is the largest at S2, the following relationship needs to be established in order for the remaining amount not to fall outside the permissible range due to these deviations.

(Target Ink-discharge Amount at *S*1+Target Ink-discharge Amount at *S*3)*0.02+(Target Ink-discharge Amount at *S*2)*0.1<3.5 ml Examples satisfying the above-described relationship include the following. For example, it is assumed that the total of the target ink-discharge amounts at S1-S3 is 40 ml. Assuming that all this total of ink is discharged by the driving of the pump 51, the amount of ink to be discharged may deviate by 4 ml (40 ml*0.1) at the largest which is greater than 3.5 ml. In this case, the amount of ink discharged unfortunately exceeds the permissible range. To address this problem, it is assumed that the target ink-discharge amount is 20 ml at S1, 5 ml at S2, and 15 ml at S3, for example. In this case, the amount of ink to be discharged may deviate by 1.2 ml ((20 ml+15 ml)*0.02+5 ml*0.1) at the largest which is less than 3.5 ml. Accordingly, the deviation of the remaining amount of the ink falls within the permissible range. The number of ink ejections is set at a value obtained by dividing 20 ml by an amount of ink to be ejected per ejection at S1, and the number of ink ejections is set at a value obtained by dividing 15 ml by an amount of ink to be ejected per ejection at S3.

A deviation exceeding 2% may be assumed as the largest deviation at S1 or S3, and a deviation exceeding 10% may be assumed as the largest deviation at 52. For example, on the assumption that an error of the ink discharge amount adheres to the normal distribution, 2σ or 3σ may be assumed to be the largest deviation in a case where +2% or +10% corresponds to the confidence interval of 1σ.

In the present embodiment described above, the head drive circuit 151 is controlled in the ink removing processing to drive the actuator units 19 to discharge the ink from the head 1. This configuration enables accurate adjustment of the remaining amount of ink in the head 1 after the ink removing processing, when compared with the case where the ink is discharged from the head 1 only by the driving of the pump 51.

In the present embodiment, the ink removing processing is started in the state in which the level of the liquid surface Si in the sub-tank 40 is maintained near H1 in FIG. 4 under the control of the supply controller 203. This configuration allows easy setting of the total target ink-discharge amount at S1-S3.

In the present embodiment, not only the actuator units 19 but also the pump 51 is driven in the ink removing processing. However, the pump 51 is driven only in a period in which the level of the liquid surface Si in the sub-tank 40 lowers from H2 to H3. That is, the pump 51 is driven only in a period in which the ink cannot be discharged from the sub-tank 40 by the driving of the actuator units 19. Accordingly, the pump 51 having a relatively large error in the ink discharge amount is driven as short as possible, enabling accurate adjustment of the remaining amount of ink in the head 1 after the ink removing processing.

While the embodiment of the present invention has been described above, it is to be understood that the invention is not limited to the details of the illustrated embodiment, but may be embodied with various changes and modifications, which may occur to those skilled in the art, without departing from the spirit and scope of the invention.

In the above-described embodiment, for example, both of the actuator units 19 and the pump 51 are driven in the ink removing processing to remove the ink from the sub-tank 40 and the head 1. This operation is performed in order to discharge the ink from the sub-tank 40 in consideration of the positional relationship between the ink passages 61, 62 as described above. However, the ink removing processing may be executed using only the driving of the actuator units 19 as long as all the ink can be discharged from the sub-tank 40. For example, the printer 1 is configured such that when the ink is discharged from the head 1 by the driving of the actuator units 19, the ink stored in the sub-tank 40 flows into the head 1 via the ink passage 61.

In the above-described embodiment, the pump 51 is driven only in the period in which the level of the liquid surface Si in the sub-tank 40 is located between H2 and H3. However, the pump 51 may be driven for a longer time as long as the remaining amount of ink in the head 1 falls within the permissible range even if the error occurs.

The liquid ejection apparatus according to the present invention is not limited to the printer and may be a device such as a facsimile machine and a copying machine. The number of heads included in the liquid ejection apparatus is not limited to one and may be two or more. The head is not limited to the line head and may be a serial head. The liquid ejection apparatus according to the present invention may eject liquid which differs from ink.

What is claimed is:

1. A liquid ejection apparatus, comprising:

a liquid ejection head comprising:

an ejection opening portion from which the liquid ejection head ejects liquid;

a supply flow passage through which the liquid is supplied to the ejection opening portion; and an actuator configured to apply ejection energy to the liquid in the supply flow passage to cause the liquid to be ejected from the ejection opening portion;

a drive configured to drive the actuator to cause the liquid to be ejected from the ejection opening portion;

a first tank connected to the liquid ejection head such that when the actuator is driven to eject the liquid from the ejection opening portion, the liquid is supplied to the supply flow passage by an amount corresponding to an amount of the liquid ejected;

a pump configured to cause the liquid in the first tank to flow into the supply flow passage; and a controller configured to execute:

a first control in which the controller controls the actuator, or the actuator and the pump, to cause the liquid in the first tank to flow into the supply passage until the first tank becomes empty of the liquid; and a second control in which, after a completion of the first control, the controller controls the pump and the drive to drive the actuator in a state in which the pump is stopped, to discharge the liquid in the supply flow passage from the ejection opening portion such that an amount of the liquid in the supply flow passage falls within a predetermined range.

2. A liquid ejection apparatus, comprising:

a liquid ejection head comprising:

an ejection opening portion from which the liquid ejection head ejects liquid;

a supply flow passage through which the liquid is supplied to the ejection opening portion; and an actuator configured to apply ejection energy to the liquid in the supply flow passage to cause the liquid to be ejected from the ejection opening portion;

a drive configured to drive the actuator to cause the liquid to be ejected from the ejection opening portion;

a first tank connected to the liquid ejection head such that when the actuator is driven to eject the liquid from the ejection opening portion, the liquid is supplied to the supply flow passage by an amount corresponding to an amount of the liquid ejected;

a pump configured to cause the liquid in the first tank to flow into the supply flow passage;

a first passage forming member formed with a first liquid passage extending from the first tank to the supply flow passage via the pump;

a second passage forming member formed with a second liquid passage extending from the first tank to the supply flow passage not via the pump; and a controller configured to execute:

a first control in which the controller controls the drive and the pump to drive the actuator, or the actuator and the pump such that all the liquid in the first tank flows to the supply flow passage; and a second control in which, after a completion of the first control, the controller controls the pump and the drive to drive the actuator in a state in which the pump is stopped, to discharge the liquid in the supply flow passage from the ejection opening portion such that an amount of the liquid in the supply flow passage falls within a predetermined range;

wherein the first passage forming member and the first tank are connected to each other at a first connecting portion which is located below a second connecting portion at which the second passage forming member and the first tank are connected to each other; and wherein the controller is configured to control the drive and the pump in the first control to drive the pump without driving the actuator in a period extending from a time point when a liquid surface of the liquid in the first tank reaches the second connecting portion to a time point when the liquid surface reaches the first connecting portion.

3. The liquid ejection apparatus according to claim 2;

wherein the controller is configured to control the drive and the pump in the second control to drive the actuator without driving the pump in a period extending from a time point when the liquid surface reaches the first connecting portion to a completion of the second control.

4. The liquid ejection apparatus according to claim 2;

wherein the controller is configured to control the drive and the pump in the first control to drive the actuator without driving the pump in a period extending from a start of the first control to a time point when the liquid surface reaches the second connecting portion.

5. A liquid ejection apparatus, comprising:

a liquid ejection head comprising:

an ejection opening portion from which the liquid ejection head ejects liquid;

a supply flow passage through which the liquid is supplied to the ejection opening portion; and an actuator configured to apply ejection energy to the liquid in the supply flow passage to cause the liquid to be ejected from the ejection opening portion;

a drive configured to drive the actuator to cause the liquid to be ejected from the ejection opening portion;

a first tank connected to the liquid ejection head such that when the actuator is driven to eject the liquid from the ejection opening portion, the liquid is supplied to the supply flow passage by an amount corresponding to an amount of the liquid ejected;

a pump configured to cause the liquid in the first tank to flow into the supply flow passage;

a second tank connected to the first tank and configured to store the liquid;

a liquid amount keeper configured to cause the liquid to flow from the second tank into the first tank to keep an amount of the liquid in the first tank, within a preset range; and a controller configured to execute:

a first control in which the controller controls the drive and the pump to drive the actuator, or the actuator and the pump such that all the liquid in the first tank flows to the supply flow passage; and a second control in which, after a completion of the first control, the controller controls the pump and the drive to drive the actuator in a state in which the pump is stopped, to discharge the liquid in the supply flow passage from the ejection opening portion such that an amount of the liquid in the supply flow passage falls within a predetermined range;

wherein the controller is configured to start the first control in a state in which the amount of the liquid in the first tank is kept within the preset range by the liquid amount keeper; and wherein the liquid amount keeper is configured to stop the liquid from flowing from the second tank into the first tank during the first control and the second control.

6. A method of controlling a liquid ejection apparatus, the liquid ejection apparatus comprising: a liquid ejection head comprising (i) an ejection opening portion from which the liquid ejection head ejects liquid, (ii) a supply flow passage through which the liquid is supplied to the ejection opening portion, and (iii) an actuator configured to apply ejection energy to the liquid in the supply flow passage to cause the liquid to be ejected from the ejection opening portion; a drive configured to drive the actuator to cause the liquid to be ejected from the ejection opening portion; a first tank connected to the liquid ejection head such that when the actuator is driven to eject the liquid from the ejection opening portion, the liquid is supplied to the supply flow passage by an amount corresponding to an amount of the liquid ejected; and a pump configured to cause the liquid in the first tank to flow into the supply flow passage, the method comprising:

controlling the actuator, or the actuator and the pump, to cause the liquid in the first tank to flow into the supply passage until the first tank becomes empty of the liquid; and thereafter controlling the pump and the drive to drive the actuator in a state in which the pump is stopped, to discharge the liquid in the supply flow passage from the ejection opening portion such that an amount of the liquid in the supply flow passage falls within a predetermined range.

* * * * *